US005269506A

United States Patent [19]

Olson et al.

[11] Patent Number: 5,269,506

[45] Date of Patent: Dec. 14, 1993

[54] PAPER PICK-UP SYSTEM FOR PRINTERS

[75] Inventors: Allan G. Olson, Camas; Steve O. Rasmussen, Vancouver, both of Wash.

[73] Assignee: Hewlett-Packard Company, Palo Alto, Calif.

[21] Appl. No.: 954,541

[22] Filed: Sep. 29, 1992

[51] Int. Cl.[5] ..... B65H 3/52

[52] U.S. Cl. ..... 271/121

[58] Field of Search ..... 271/121, 124, 125

[56] References Cited

U.S. PATENT DOCUMENTS

| | | | |
|---|---|---|---|
| 442,028 | 12/1890 | Field . | |
| 973,385 | 10/1910 | Resch . | |
| 1,058,314 | 4/1913 | Lynch . | |
| 1,104,015 | 7/1914 | Stickney . | |
| 1,162,507 | 11/1919 | Petermann . | |
| 1,976,788 | 10/1934 | Kurth . | |
| 3,035,834 | 5/1962 | Bottrell . | |
| 3,369,804 | 2/1968 | Schulze et al. . | |
| 3,642,273 | 2/1972 | Baglio . | |
| 3,768,803 | 10/1973 | Stange . | |
| 3,966,189 | 6/1976 | Taylor et al. . | |
| 4,032,135 | 6/1977 | Rüenzi | 271/124 |
| 4,056,193 | 11/1977 | Yoshida . | |
| 4,219,192 | 8/1980 | Burke . | |
| 4,312,503 | 1/1982 | Saxinger et al. | 271/124 |
| 4,431,175 | 2/1984 | Smith . | |
| 4,457,507 | 7/1984 | Ishikawa et al. . | |
| 4,475,732 | 10/1984 | Clausing et al. . | |
| 4,526,358 | 7/1985 | Ura et al. | 271/124 |
| 4,535,981 | 8/1985 | Watanabe et al. | 271/124 |
| 4,579,332 | 4/1986 | Larson . | |
| 4,662,536 | 5/1987 | Powers . | |
| 4,667,947 | 5/1987 | Costa et al. . | |
| 4,728,963 | 3/1988 | Rasmussen et al. . | |
| 4,786,039 | 11/1988 | Ito . | |
| 4,815,724 | 3/1989 | Sumida et al. | 271/124 |
| 4,865,306 | 9/1989 | Himegi | 271/124 |
| 5,000,594 | 3/1991 | Beehler et al. . | |
| 5,052,676 | 10/1991 | Shiina et al. | 271/121 |
| 5,104,113 | 4/1992 | Kameyama et al. | 271/124 |
| 5,114,134 | 5/1992 | Rasmussen et al. . | |
| 5,192,068 | 3/1993 | Parker et al. | 271/121 |

FOREIGN PATENT DOCUMENTS

| | | | |
|---|---|---|---|
| 135039 | 10/1980 | Japan | 271/124 |
| 57-4838 | 1/1982 | Japan . | |
| 60-97141 | 5/1985 | Japan . | |
| 60-165276 | 8/1985 | Japan . | |
| 60-160268 | 7/1986 | Japan . | |
| 61-188337 | 8/1986 | Japan . | |
| 208451 | 8/1988 | Japan | 271/121 |
| 63-282028 | 11/1988 | Japan . | |
| 3195642 | 9/1991 | Japan | 271/121 |
| 3195643 | 9/1991 | Japan | 271/121 |
| 2061231A | 5/1981 | United Kingdom . | |

OTHER PUBLICATIONS

*IBM Technical Disclosure Bulletin,* Paper Feed System by L. Adams, Jr., vol. 24, No. 10, pp. 5028–5030, Mar. 1982.

*IBM Technical Disclosure Bulletin,* Paper Feed Mechanism, vol. 30, No. 3, pp. 1037–1038, Aug. 1987.

*Hewlett Packard Journal,* DeskJet Printer Chassis and Mechanism Design by Larry A. Jackson, Kieran B. Kelly, David W. Pinkernell, Steve O. Rasmussen, and John A. Widder, pp. 67–75, Oct. 1988.

*Primary Examiner*—David H. Bollinger

[57] ABSTRACT

A separator is provided for use in a sheet pick-up system, the separator including a rigid body having a base portion and a wear-resistant upstanding portion. The separator is mounted adjacent the printer's input port and is biased toward a motor-driven roller, pinching input sheets between the roller and the separator's upstanding portion so that the roller may pull the top sheet across the second sheet and the upstanding portion. A frictionally adherent pad is formed in operative association with the body so as to extend in a region forward of the upstanding portion and contact the second sheet to oppose intake thereof.

9 Claims, 3 Drawing Sheets

PAPER PICK-UP SYSTEM FOR PRINTERS

TECHNICAL FIELD

The present invention relates generally to a system for use in transferring sheets from an input tray to a printer's input port. More particularly, the invention relates to a sheet pick-up system which includes mechanism for separating sheets as they are fed into the input port of a single-sheet printer.

BACKGROUND ART

In a conventional single-sheet printer, sheets of paper are pulled from a stack and fed into the printer's input port so as to begin the print cycle. Such an operation, commonly known as sheet pick-up, is accomplished by peeling the top sheet from the stack using a motor-driven roller. The roller, which generally includes a frictionally adherent rolling surface, rotates against the upper surface of the top sheet, directing passage of that sheet into the printer.

Due to frictional forces between consecutively stacked sheets, pick-up of the top sheet is often accompanied by unwanted pick-up of a second sheet, an event which may lead to paper jam. This problem is particularly prevalent where the input stack is a stiff stack, such stacks being characterized by high frictional forces between sheets.

In order to avoid pick-up of multiple sheets, some printers have been fitted with a device known as a separator. The separator, which includes a frictionally adherent surface, is mounted to the printer adjacent the roller and biased toward engagement therewith. Sheets pulled from the stack are pinched between the roller and the separator so that the roller exerts a first frictional force against the upper surface of the top sheet and the separator exerts a second opposing frictional force against the bottom surface of the second sheet. The top sheet is thus intended to slide across the second sheet and into the printer.

The above-described arrangement, however, has presented several problems. First, known separators have characteristically engaged all sheets entering the printer, including the top sheet. Intake of the top sheet is thus opposed by the separator. Due to the sliding frictional engagement between the top sheet and the separator, previously developed separators have also been characterized by unacceptably rapid wear with such wear leading to excessive downtime and frequent separator replacement. Additionally, after the picked-up sheet passes completely into the printer's input port, and there is no paper separating the roller and the separator, known printers have produced an undesirable whine or squeal due to contact between like surfaces.

DISCLOSURE OF THE INVENTION

The invented pick-up system employs a separator which includes a rigid body having a base portion and a wear-resistant upstanding portion, such upstanding portion being rearwardly adjacent a frictionally adherent pad. The separator is mounted adjacent the printer's input port and is biased toward a motor-driven roller so as to pinch the top two sheets from an input stack between the roller and the separator's upstanding portion. The roller thus pulls the top sheet across the second sheet and the upstanding portion. The pad, which extends in a region forward of the upstanding portion, opposes intake of the second sheet.

DETAILED DESCRIPTION AND BEST MODE FOR CARRYING OUT THE INVENTION

Figure 1:
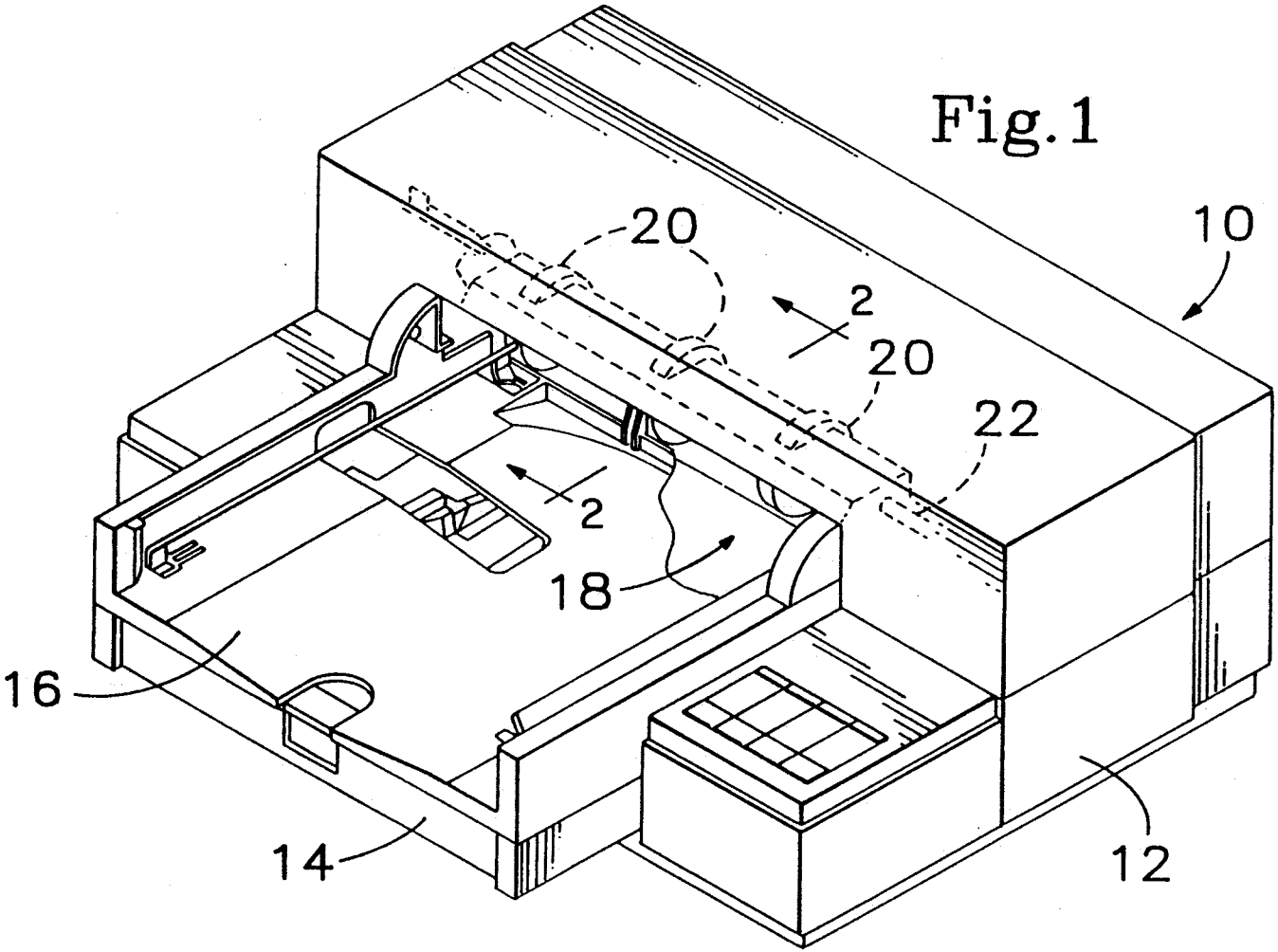
FIG. 1 is an isometric view of a printer employing a sheet pick-up system according to the present invention.

Referring initially to FIG. 1, a single-sheet printer 10 is depicted, such printer being suitable for use in combination with the invented sheet pick-up system. As shown, printer 10 is of conventional design, including a chassis 12, an input tray 14, and an output tray 16 (shown partially cut away). Paper is pulled into the printer's input port 18, one sheet at a time, using a sheet pick-up system which includes a plurality of spaced drive rollers 20. The rollers are operatively connected to a motor-driven drive shaft 22 and rotated under the direction of an onboard control system (not shown).

Figure 2:
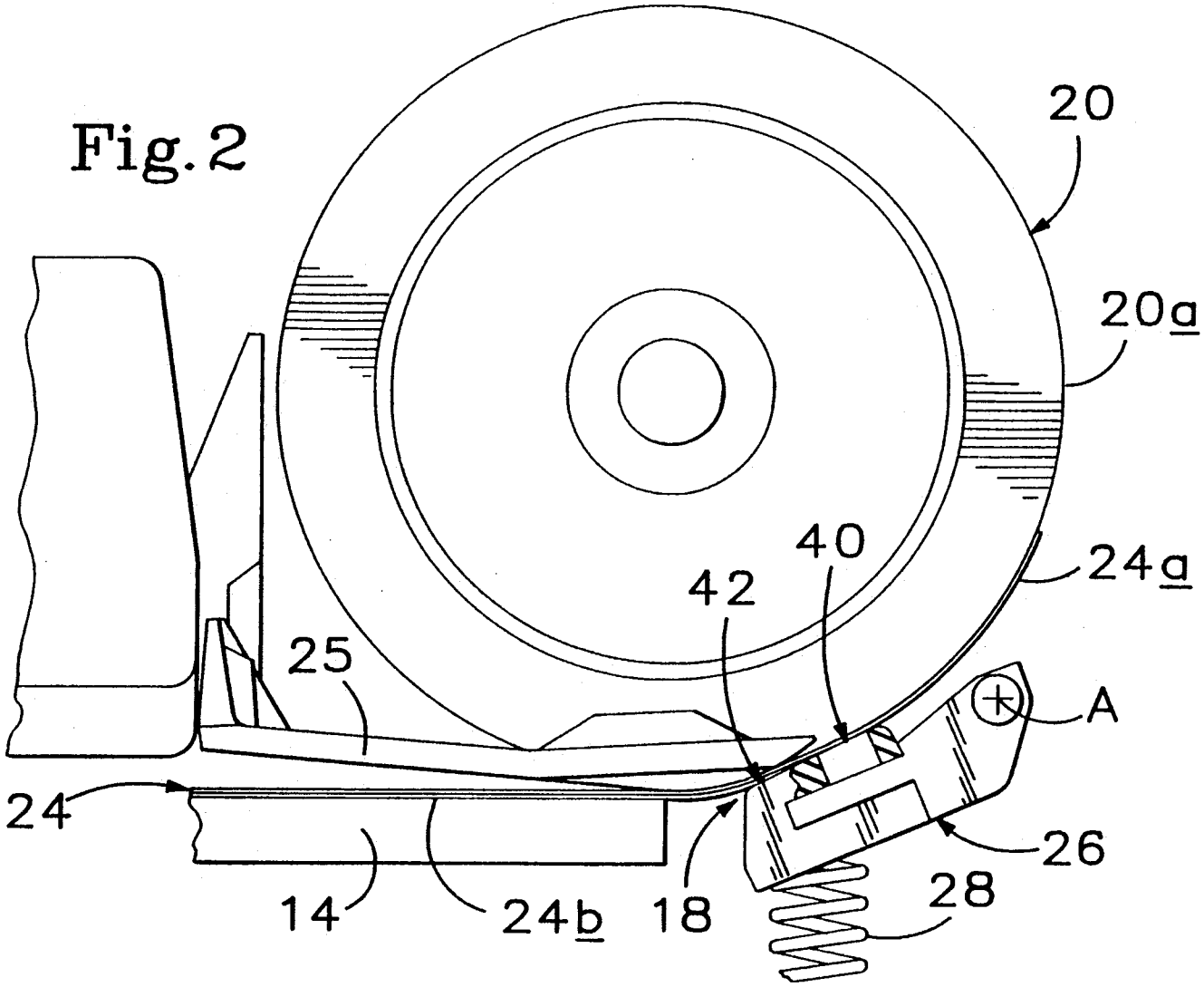
FIG. 2 is a simplified environmental view taken generally along line 2—2 in FIG. 1, the referenced area being enlarged so as to illustrate pick-up of a top sheet from an input stack using the invented sheet pick-up system.

Turning now to FIG. 2, and focusing attention more specifically on the mechanism by which paper is pulled into the printer, it will be appreciated that the above-described rollers are mounted so as to selectively engage a sheet stack 24. The sheet stack, which rests on input tray 14, is positioned so as to allow sliding passage of a sheet **24*a* from the top of the stack into the printer's input port. Toward this end, the stack is positioned via spring bias of the input tray so that top sheet 24*a* is at a position substantially accommodating insertion of such sheet into input port 18. Where it is desired to avoid sheet pick-up, a paper sled 25 is used to urge the sheet stack below the position which accommodates sheet insertion. The rollers, each of which includes a frictionally adherent rolling surface 20*a*, roll across the top sheet, pulling it into the printer's input port. Frictional forces between the top sheet and other sheets, such as second sheet 24*b*** leads to the pull of multiple sheets toward the input port, an undesirable effect which will now be addressed.

In order to oppose input of a sheet, the printer is supplied with a separator 26. The separator, along with the rollers described above, makes up a sheet pick-up system which, in turn effects intake of sheets. As shown, in FIG. 2, the separator is mounted adjacent the input port just below one of the rollers 20. In the preferred embodiment roller 20 is positioned generally transversely centrally along input port 18. The separator is pivotally secured to the chassis about a transverse axis A and is biased toward engagement with the roller by a member such as spring 28. As paper is pulled into the input port, it is pinched between the separator and roller to effect separation of the sheets as will be further described below. Such sheet separation, it will be appreciated, results in continued carriage of the top sheet into the printer without corresponding carriage of the second sheet.

Figure 3:
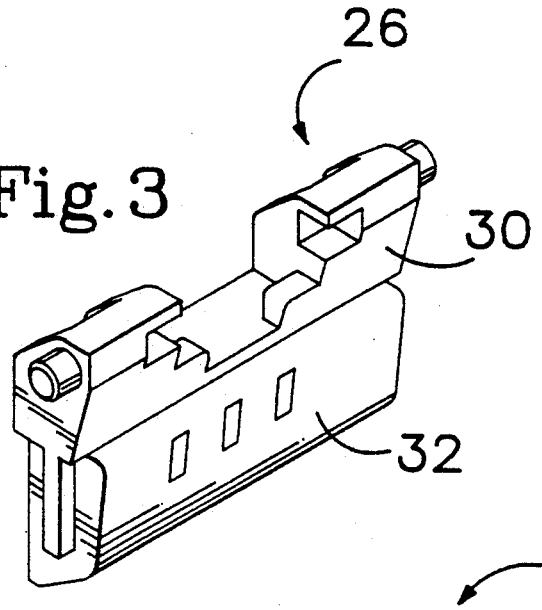
FIG. 3 is an enlarged isometric view of the separator employed in FIGS. 1 and 2.
Figure 4:
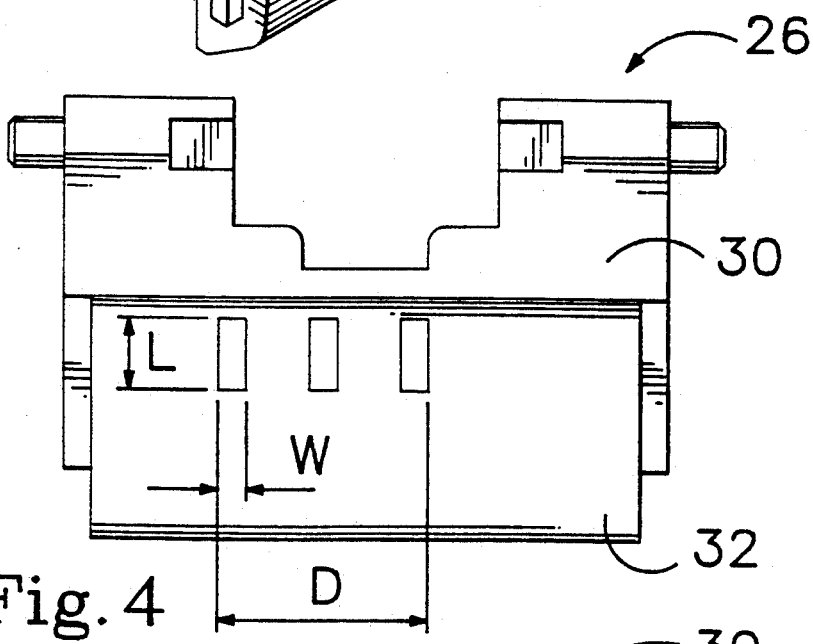
FIG. 4 is a further enlarged plan view of the separator depicted in FIG. 3.
Figure 5:
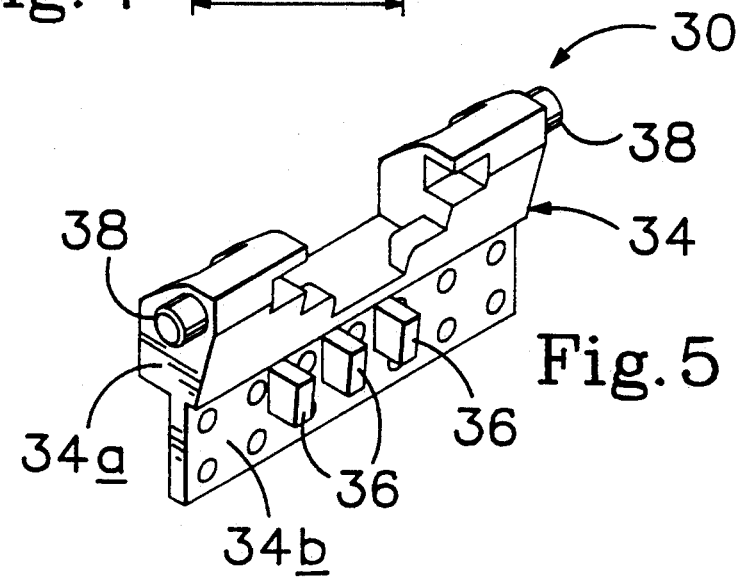
FIG. 5 is an isometric view showing the separator's body independently.

Bringing FIGS. 3–5 into the discussion, and further focusing attention on the separator, the reader will see that separator 26 is made up of a generally rigid body 30 and a resilient pad 32. Body 30, which is shown independently in FIG. 5, includes a generally horizontal base portion 34 from which extend a plurality of upstanding portions 36. The body is formed from a rigid, wear-resistant material such as nylon, and is generally molded as a unitary piece.

The base portion, it will be appreciated, may be considered to include a mounting subportion **34*a* and a generally planar subportion 34*b*, with the mounting subportion being used in pivotally securing the separator to the printer's chassis. Such pivotal securement is accomplished via a pair of pins 38 which extend oppositely from the mounting subportion and seat in corresponding chassis structure (not shown). A recessed channel is also provided in the mounting subportion to accommodate securement of the separator without interfering with other printer components. Planar subportion 34*b* extends forwardly from the mounting subportion and is adapted for operative association with the separator's resilient pad 32**. In the preferred embodiment, the pad is molded to the body, the body's planar subportion being formed with plural holes through which pad material extends.

As shown, the body's upstanding portions are generally parallelepiped-shaped, such portions being positioned somewhat transversely centrally on planar subportion **34*b*. The upstanding portions, as best shown in FIG. 4, each have a width W of approximately 1.5 millimeters and a length L of approximately 3.75 millimeters. They are equally spaced, spanning a transverse distance D of approximately 9.7 millimeters, a distance which closely corresponds to the width of the roller 20. The height of the upstanding portions is generally constant, corresponding to the thickness of the separator's pad when initially formed (see FIG. 2**). Although the thickness of the pad decreases due to wear, the thickness of the upstanding portions remains relatively constant.

In the depicted embodiment, pad 32 substantially surrounds the upstanding portions, extending forwardly therefrom a distance approximately twice the length of the upstanding portions. The pad is formed from a frictionally adherent material such as rubber, and is effective in selectively opposing passage of paper thereacross. As best shown in FIGS. 2 and 3, the forwardmost portion of the pad angles somewhat downwardly as it extends from the upstanding members. The edges of the pad are rounded to better accommodate sheet passage thereover.

Referring once again to FIG. 2, and considering with particularity the effect of employing the just-described separator, the reader will understand that such separator is configured so as to oppose input of second sheet **24*b* until after the top sheet 24*a* is taken completely into the printer. This is accomplished without unduly opposing input of top sheet 24*a*. Such effect is due to the varying frictional forces applied by the separator in different regions thereof. The top sheet engages the separator in a first surface region 40, such region being characterized by the application of a relatively low first frictional force against the sheet passing thereacross. This paper-to-pad frictional force, it will be understood, is less than the corresponding frictional force between the rollers and the first sheet. This relatively low frictional force is at least partially due to the positioning of the upstanding portions, such portions offering a relatively low frictional force in opposition to sheet passage as described above. In contrast, the second sheet engages the separator in a second surface region 42. Region 42 is characterized by a higher second frictional force applied to the second sheet. The second region is preferably defined entirely by pad 32**. The pad, as described above, is formed from a frictionally adherent material so as to oppose sheet passage thereacross. This paper-to-pad frictional force for the second sheet is thus greater than the paper-to-paper frictional forces between the first and second sheets and the papers are separated as they enter the input port.

By virtue of the separator's pivotability, the regions may be arranged selectively so as to exert different frictional forces against different sheets. Additionally, because the roller is positioned directly over the first region, and because the first region is defined in large part by the upstanding portions, annoying sounds due to passage of the roller across the separator are alleviated. This also effects shower wear of the separator and thus less frequent separator replacement.

INDUSTRIAL APPLICABILITY

In a single-sheet printer, sheets are taken from an input stack, one at a time, the sheets being peeled from the stack by a drive roller as described above. This action, however, requires sliding passage of one sheet across the next-below sheet. Consequently, sheets tend to move together, an undesirable effect. Because the force which prevents the second sheet from moving forward is generally the same or less than the force which prevents the first sheet from going forward, the problem of multiple sheet pull exists. The invented system employs a separator with regions of disparate coefficents of friction to allow passage of the top sheet while opposing passage of the second sheet. The region with a lower coefficient of friction is also characterized by wear-resistant portions, such portions slowing separator wear which is generally due to passage of paper thereacross.

We claim:

1. In a single-sheet printer sheet pick-up system which includes a roller for pulling a first sheet from a sheet stack and into the printer's input port, a sheet separator for opposing pick-up of a lower second sheet, said separator comprising:

a generally rigid body mounted adjacent the printer's input port, said body having a base portion and an upstanding portion which underlies the roller selectively to pinch sheet media between the roller and said upstanding portion, said upstanding portion being formed from a first material; and a pad operatively connected to said upstanding portion and surrounding the same to selectively engage the second sheet, said pad being formed from a frictionally adherent second material to oppose carriage of the second sheet into the printer's input port;

said first material being more resistant to wear than said second material so as to oppose pad wear by providing an upstanding portion of generally constant height.

2. The separator of claim 1, wherein said separator defines a first surface region configurable to apply a first frictional force against the first sheet when the first sheet engages said first surface region, and a second surface region configurable to apply a second higher frictional force against the second sheet when the second sheet engages said second surface region.

3. The separator of claim 2, wherein said first surface region is at least partially defined by said upstanding portion.

4. The separator of claim 1, wherein said pad is formed from rubber.

5. The separator of claim 1, wherein said separator is pivotable about a transverse axis to accommodate engagement between said pad and the second sheet.

6. The separator of claim 1, wherein said upstanding portion is positionable to allow for ready passage of the roller thereacross.

7. The separator of claim 1, wherein said upstanding portion is positionable to allow for ready passage of the first sheet thereacross.

8. The separator of claim 1, wherein said upstanding portion is formed from nylon.

9. In a single-sheet printer sheet pick-up system which includes a roller for pulling a first sheet from a sheet stack and into the printer's input port, a sheet separator positioned below the roller for opposing pick-up of a lower second sheet by operative engagement between the roller and sheet separator, said separator comprising:

a generally rigid body mounted adjacent the printer's input port, said body having a base portion and a plurality of upstanding portions which directly underlie the roller selectively to pinch the top sheet between said upstanding portions and the roller, said upstanding portions being formed from a rigid first material which offers a relatively low frictional force in opposition to sheet media passage thereacross; and a pad operatively connected to said upstanding portions and surrounding said upstanding portions to selectively engage the second sheet, said pad being formed from a resilient, frictionally adherent, second material which offers a relatively high frictional force in opposition to passage of sheet media thereacross, said pad opposing carriage of the second sheet into the printer's input port;

said first material being more resistant to wear than said second material so as to oppose pad wear by providing an upstanding portion of generally constant height.

* * * * *